US005752623A

United States Patent [19]

Reid

[11] Patent Number: 5,752,623

[45] Date of Patent: May 19, 1998

[54] DISPENSING MACHINE

[76] Inventor: John Nicholas Reid, Whiteoak, Barling Road, Wakering, Essex SS0 3ND, Great Britain

[21] Appl. No.: 591,622

[22] PCT Filed: Jul. 22, 1994

[86] PCT No.: PCT/GB94/01584

§ 371 Date: Jan. 22, 1996

§ 102(e) Date: Jan. 22, 1996

[87] PCT Pub. No.: WO95/03594

PCT Pub. Date: Feb. 2, 1995

[30] Foreign Application Priority Data

Jul. 22, 1993 [GB] United Kingdom ..... 9315248

[51] Int. Cl.[6] ..... A24F 27/14

[52] U.S. Cl. ..... 221/150 HC; 221/70

[58] Field of Search ..... 221/150 HC, 150 R, 221/150 A, 69, 70, 71, 73, 9, 13, 192, 217, 218, 259, 253

[56] References Cited

U.S. PATENT DOCUMENTS

| | | | |
|---|---|---|---|
| 3,224,361 | 12/1965 | Ojelid | 99/332 |
| 3,340,789 | 9/1967 | Simjian | 99/352 |
| 3,817,422 | 6/1974 | Raitt | 221/74 |
| 3,984,030 | 10/1976 | Morini | 221/30 |
| 4,146,150 | 3/1979 | Low et al. | 221/30 |
| 4,519,523 | 5/1985 | McElwee | 221/13 |

FOREIGN PATENT DOCUMENTS

| | | |
|---|---|---|
| 9213323 | 8/1992 | European Pat. Off. . |
| 1427560 | 12/1965 | France . |
| 2101742 | 3/1972 | France . |
| 2284937 | 4/1976 | France . |
| 2458851 | 1/1981 | France . |
| 364343 | 4/1990 | France . |
| 581654 | 2/1994 | France . |
| 996039 | 6/1965 | United Kingdom . |
| 1134905 | 11/1968 | United Kingdom . |
| WO9403876 | 2/1994 | WIPO . |

*Primary Examiner*—Kenneth Noland

*Attorney, Agent, or Firm*—Knobbe, Martens, Olson & Bear, LLP

[57] ABSTRACT

A dispensing machine for dispensing items of hot food comprises a freezer compartment for storing the items to be dispensed, a heating compartment, a dispensing location and a transport mechanism for receiving items from the freezer compartment, via the heating compartment, to the dispensing location. The transport mechanism has a flexible transport web to which the items to be dispensed are secured. Driving means advance the web from the freezer compartment to the dispensing location. The web has code markings on it indicating the positions of the food items on the web. A code reader reads the code markings, to control the driving means for advancing the web.

17 Claims, 1 Drawing Sheet

DISPENSING MACHINE

FIELD OF THE INVENTION

The present invention relates to a dispensing machine for dispensing items of hot food, comprising a freezer compartment for storing the items to be dispensed, a heating compartment, a dispensing location and a transport mechanism for conveying items from the freezer compartment, via the heating compartment, to the dispensing location, the transport mechanism comprising a flexible transport web to which the items to be dispensed are secured and driving means for advancing the web from the freezer compartment to the dispensing location.

DESCRIPTION OF THE PRIOR ART

A dispensing machine as described above is known from GB-A-996,039. In this machine, an oven that is open from above and below is located inside the freezer compartment. The transport mechanism includes a wheel with a polygonal circumference positioned next to the top of the oven and allows an item that is to be dispensed to drop under its own weight into the oven when the wheel is rotated. After the item has been heated, it is severed from the transport web and allowed to fall under its own weight into the dispensing location.

In the above machine, it is essential that the polygonal wheel be dimensioned such that its sides are of the same length as the distance between food items on the transport web. Consequently, the machine cannot readily accommodate food items of different size. A more serious disadvantage is that the web can only be indexed by a distance equal in length to one side of the polygonal wheel as a result of which the heating compartment is obliged to be very near, or within, the freezer compartment, which is undesirable.

OBJECT OF THE INVENTION

The present invention therefore seeks to provide a hot food dispensing machine in which the transport mechanism can permit a wide separation on the web of the individual food items so that the freezer compartment and heating compartment can be distant from one another.

SUMMARY OF THE INVENTION

According to the present invention, there is provided a dispensing machine for dispensing items of hot food, comprising a freezer compartment for storing the items to be dispensed, a heating compartment, a dispensing location and a transport mechanism for conveying items from the freezer compartment, via the heating compartment, to the dispensing location, the transport mechanism comprising a flexible transport web to which the items to be dispensed are secured and driving means for advancing the web from the freezer compartment to the dispensing location, characterised in that the web carries code markings indicating the positions of the food items on the web and in that a code reader is provided to read the code markings, the driving means for advancing the web being operated in dependence upon the output of the code reader.

The heating compartment in GB-A-996,039 is located within the freezer compartment. This is unavoidable in the latter patent because the indexing movement of the web is very short and the items must remain frozen until such time as they are to be dispensed.

In the present invention, by contrast, any length of web can be used between items and the web is simply advanced first until such time as the item is located in the heating compartment, then until such time as the item is separated from the web and dispensed.

In GB-A-996,039, the items are permanently secured to the web and are dispensed by cutting off a length of web with the food item secured to it. This requires the dispensing location also to be located near the heating compartment.

In the preferred embodiment of the invention, the food items are releasably secured to the web, being for example lightly glued or stapled to the items. In this way pulling of the web away from the surface of the items can be used to separate the items from the web at the dispensing location allowing the web to be wound onto a take-up reel while the items slide under their own weight to the dispensing location. The dispensing location can therefore be positioned at will within the machine.

It is advantageous to provide additional code markings on the web, to identify the product carried by the web. In this way, the cooking time and price of the item can be read automatically from the web, avoiding the need for the program of the machine to be modified when it is replenished with a different product. Such code markings need only be provided once on the web, on the leader or before the first item.

The leader of the web may also carry other information, for example a sell-by date, to allow products to be dispensed in correct sequence and to avoid the sale of products after their sell-by date.

According to a second aspect of the invention, there is provided a web for use in an automated hot food dispensing machine, the web having secured thereto items of food to be dispensed and having code markings thereon to identify the positions of the items on the web.

BRIEF DESCRIPTION OF THE DRAWING

The invention will now be described by way of example with reference to the accompanying drawings, which is a section through a dispensing machine embodying the invention.

DETAILED DESCRIPTION OF THE PREFERRED EMBODIMENT

Figure 1:
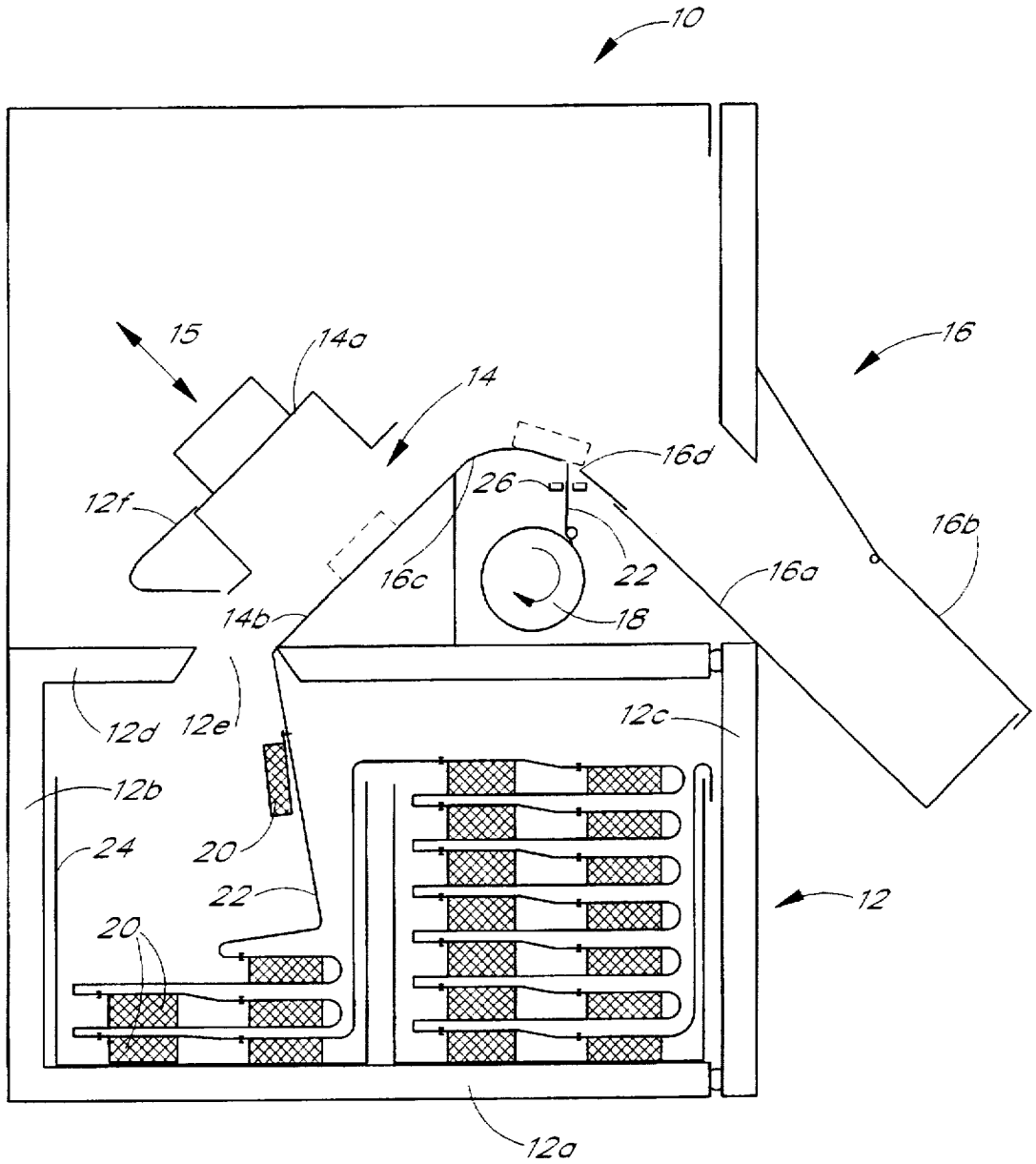

In the drawing, a dispensing machine 10 includes a freezer compartment 12 having a base **12*a*, sides 12*b*, a loading door 12*c* and a top 12*d*. An opening 12*e* in the top 12*d* of the freezer compartment can be opened and closed by a door 12*f* that is mounted on a housing 14*a* of a microwave oven 14. The housing 14*a* and the door 12*f* are movable in the direction of the arrow 15 towards and away from an inclined surface 14*b*** that forms the base of the microwave oven.

The dispensing location 16 of the machine has a chute **16*a* with a lid 16*b*. The chute 16*a* is inclined in the opposite direction to the base 14*b* of the microwave oven and is connected to it by a curved ramp 16*c* . The ramp 16*c* is formed with a slot 16*d* through which a flexible web 22 used to transport the items to be dispensed is threaded onto a take-up reel 18**.

Within the freezer compartment 12 the items 20 to be dispensed are arranged in boxes 24. All the items within a box are secured to the flexible web 22 that is fan folded into the box 24. The connection between the web and the individual items preferably takes the form of an H-shaped plastics staple that is inserted into holes in the web 22 and the items 20. Similar staples are often used to attach labels to articles of clothing.

The web 22 carries code markings that are readable by an optical decoder 26 located near the take-up reel 18. These code markings, which may be bar codes punched holes or any other form of machine recognisable markings, indicate the position of the next item on the web. This information is used in controlling the mechanism transporting the items through the various stations in the machine to ensure that the microwave oven is not operated when empty and to ensure that an item has been correctly dispensed.

In the illustrated embodiment, the take-up reel 18 acts as the advancing mechanism. The web 22 is pulled out of the freezer compartment 12, through the microwave oven 14 and over the ramp 16*c* by a motor driving the take-up reel 18. In this case, because the diameter of the roll on the take-up reel 18 is constantly increasing, one cannot simply rotate the reel by the same number of turns in each operating cycle. Instead the motor driving the take-up reel is controlled in dependence upon the position information read from the web 22 by the decoder 26.

The proposed construction of the dispensing machine has several advantages apart from the simplification of the control of the advancing mechanism. A simple automated process may be used to punch holes in the web 22 and to place the code markings on the web. This ensures that the position of every food item 20 is correctly known from reading the code markings. The spacing between articles can therefore be varied at will to accommodate items of different sizes within the same machine and using the same advancing mechanism. Furthermore, if a code marking is correctly recognised then it is known that there will be a food item in the oven 14 when it is switched on and there will be no risk of damaging the oven by operating it while it is empty. Lastly, because the web must come away from the item before it can be rolled onto the take-up reel 18, there is no risk of a cycle being completed without the item of food being dispensed to the machine operator.

The code markings may also contain information to identify the type of article supported on the web. Such code markings can allow the heating time in the oven and the sale price to be set appropriately. Because a web will always carry items of the same type, it is not essential to repeat this information for each item and it suffices for such markings to be placed on a leader that is used to thread the web through the machine 10. Such marking of the webs avoids the need for the machine to be reprogrammed when it is replenished.

Because the take-up reel is used to pull the web through the various stations in the machine, the width of the web may be less than the width of the food items. Typically, a 3 cm strip of plasticised paper (spun bonded olefin—as used in untearable envelopes) may be used regardless of the shape and the weight of the food items. It would however be alternatively possible to use a web wider than the food items in which case the web may have sprocket holes and be driven by sprocket engaging these holes.

When using a narrow web to support the items to be dispensed, it is possible for the web to twist under the weight of the food item 20. However, as can be seen from the drawings, the item suspended in the freezer compartment tends to hang with its centre of gravity beneath the edge of the opening 12*e* and in this position it lies in the correct orientation to enter the oven 14 the correct way up and when it later reaches the positions in the oven 14 and on the dispensing chute 16*a* shown in dotted lines in the drawings it lies the right way up above the web 22. With certain types of item, such as pizzas, it is vital that they should be kept the right way up during cooking and this is achieved in the described embodiment without the need to take any special measures and by relying entirely on gravity to orient the food items 20 before they enter the oven 14.

The illustrated machine 10 has two boxes or cartridges 24 arranged one in front of the other when viewed from the direction of the front of the machine. The machine 10 may have several rows of boxes 24 arranged side by side. The boxes in the different rows may contain different items of food to be dispensed either in the same or a different operating cycle. For example, one item may be a hamburger and the other potato chips that are dispensed at the same time. Alternatively, the operator may be offered a choice of a hamburger, a hot dog and cheeseburger to be dispensed in different operating cycles.

The oven is conveniently common to a number of rows of boxes in the freezer compartment, this being the less expensive construction but it would be alternatively possible to provide separate ovens. If items requiring different heating times are to be dispensed in the same operating cycle, it would be possible to interrupt the heating of the first item to allow the second item to be introduced at a later time into the oven.

As shown in the drawing, within a row of boxes the webs 22 are connected to one another, the tail of one being connected to the leader of the next. The tail may also carry code markings to indicate that the end of the box has been reached. If the leader of the next box can be connected to the tail of the previous box ahead of the end of web marker, the encoder can determine if the end of the web has been reached or if a fresh box of items has been added to the freezer compartment.

The food items are illustrated as being stored in boxes that are arranged one in front of the other in the freezer compartment 12. This makes it difficult in practice to load boxes because the empty box at the back of the freezer compartment must somehow be removed. In a preferred alternative embodiment, the food items are packaged in a sleeve open at both ends that can be pulled out after the items have been loaded into the freezer compartment 12 leaving only the unboxed food items in the freezer. With such a construction, fresh food items can be added either in front of or beneath items already in the freezer. In the latter case, a spatula may be provided to raise the items already present in the freezer as the fresh items are being added beneath them.

The operation of the machine will be clear from the foregoing description of its construction. After an operator has selected and paid for a food item, the oven housing 14*a* is moved in the direction of the arrow 15 to open the oven 14 and the freezer compartment 12. The web 22 is advanced by turning the take-up reel 18 until the code markings on the web 22 indicate through the decoder 26 that the food item 20 has moved out of the freezer compartment and is now located in the oven 14. The housing 14*a* is then lowered and the oven 14 is operated in order to heat the food item or items. When the heating is completed, the oven is again opened by raising the housing 14*a* and the web 22 is advanced until the item is pulled over the ramp 16*c* and separated from the web 22 at the slot 16*d*. The heated food item 20 is then collected by the operator from the chute 16*a* after the lid 16*b* has been opened manually.

It will be clear that various modifications can be made to the described machine. For example, the design of the door 12*f* closing the opening 12*e* in the top of the freezer compartment 12 may be modified to include a flap that opens automatically as an item is pulled through the opening. This is advantageous in that the freezer compartment will then not be opened unnecessarily when the oven housing 14*a* is raised to allow the heated food item to pass out of the oven 14 to the dispensing location 16. Also, such a flap will tend to seal around the web when the freezer compartment is closed.

The code markings on the webs may also include other information such as a sell-by date to avoid dispensing stale items or to ensure that items are sold in the safest sequence.

I claim:

1. A dispensing machine for dispensing items of hot food, comprising:

a freezer compartment for storing the items to be dispensed, a heating compartment, a dispensing location, and a transport mechanism for conveying items from the freezer compartment, via the heating compartment, to the dispensing location, the transport mechanism comprising a flexible transport web to which the items to be dispensed are secured and driving means for advancing the web from the freezer compartment to the dispensing location, wherein the web carries code markings indicating the positions of the food items on the web and in that a code reader is provided to read the code markings, the driving means for advancing the web being operated in dependence upon the output of the code reader.

2. A dispensing machine as claimed in claim 1, wherein the food items are releasably secured to the web.

3. A dispensing machine as claimed in claim 2, wherein the food items are stapled to the web using H-shaped plastics staples passing through holes in the items and in the web.

4. A dispensing machine as claimed in claim 1, wherein additional code markings on the web are provided to identify the product carried by the web.

5. A dispensing machine as claimed in claim 1, wherein the leader of the web carries code markings to indicate the sell-by date of the items secured to the web.

6. A dispensing machine as claimed in claim 2, wherein additional code markings on the web are provided to identify the product carried by the web.

7. A dispensing machine as claimed in claim 3, wherein additional code markings on the web are provided to identify the product carried by the web.

8. A dispensing machine as claimed in claim 2, wherein the leader of the web carries code markings to indicate the sell-by date of the items secured to the web.

9. A dispensing machine as claimed in claim 3, wherein the leader of the web carries code markings to indicate the sell-by date of the items secured to the web.

10. A dispensing machine as claimed in claim 4, wherein the leader of the web carries code markings to indicate the sell-by date of the items secured to the web.

11. A web for use in an automated hot food dispensing machine, the web having releasably secured thereto items of food to be dispensed and having code markings thereon to identify the positions of the food items on the web, the web being narrower than the food items secured thereto.

12. A web as claimed in claim 11, wherein additional code markings on the web are provided to identify the product carried by the web.

13. A web as claimed in claim 11, wherein the leader of the web carries code marking to indicate the sell-by date of the items secured to the web.

14. A web as claimed in claim 11, wherein the web comprises a strip of a plasticised strip.

15. A web as claimed in claim 12, wherein the leader of the web carries code marking to indicate the sell-by date of the items secured to the web.

16. A web as claimed in claim 12, wherein the web is formed of a plasticised strip.

17. A web as claimed in claim 13, wherein the web is formed of a plasticised strip.

* * * * *